US005921316A

United States Patent [19]

McMinn

[11] Patent Number: 5,921,316

[45] Date of Patent: Jul. 13, 1999

[54] AUTOMATIC DRILL PIPE CLEANING SYSTEM AND METHOD OF USE

[76] Inventor: Jimmy McMinn, 4707 N. Cashel Cir., Houston, Tex. 77069

[21] Appl. No.: 08/861,677

[22] Filed: May 22, 1997

[51] Int. Cl.[6] ..... E21B 33/08

[52] U.S. Cl. ..... 166/90.1; 166/82.1; 175/84

[58] Field of Search ..... 166/82.1, 90.1, 166/222; 175/84, 24, 212; 15/104.03, 104.04; 134/64 R, 122 R, 199, 102.3

[56] References Cited

U.S. PATENT DOCUMENTS 1,521,390 12/1924 Reynolds ..... 166/90.1

4,606,415 8/1986 Gray, Jr. et al. ..... 175/24

4,690,213 9/1987 Stannard et al. ..... 166/84

*Primary Examiner*—Tamara Graysay

*Assistant Examiner*—Zakiya Walker

*Attorney, Agent, or Firm*—Gunn & Associates, P.C.

[57] ABSTRACT

An automatic pipe wiping system using a circular air manifold with jets which is automatically triggered to flow air at the pipe. The pipe is wiped, even when moving laterally with crooked pipe. The pipe is air blown to wipe the mud down. The air jets have a pneumatic logic circuit connected to sense upward pipe movement and start air flow to a manifold around the pipe.

24 Claims, 3 Drawing Sheets

AUTOMATIC DRILL PIPE CLEANING SYSTEM AND METHOD OF USE

BACKGROUND OF THE DISCLOSURE

The present disclosure sets forth an automatic drill pipe wiping system and one which is triggered into operation on retrieving drill pipe so the exterior of the drill pipe does not drip on the rig floor. When drilling a well, drilling fluid is pumped through the drill stem. The drilling fluid is often called mud because it has a strong resemblance to mud. It is forced down through the Kelley, flows through the pipe string the drill collars and out the drill bit at the bottom of the well. It is returned on the exterior of the drill pipe. As the hole is drilled deeper, the drill bit eventually wears out and it is then necessary to remove the drill stem from the well and replace the drill bit. When that occurs, the pipe is pulled one joint at a time until the entire drill stem has been disassembled and stacked in the derrick. Sometimes, three joints are pulled together. When pulling, drilling mud dribbles down the side of the drill pipe and splashes on the rig floor.

U.S. Pat. No. 4,690,213 is a representative pipe wiping device. It shows a mechanism incorporating left and right flexible wiper elements. The wipers have V-shaped edges in them to reach around the pipe so a significant portion of the exterior is wiped. This device is installed at a location where it cannot be seen in operation. Normally it is placed under the rig floor. When a trip is made, it can only be assumed the wiper device is operative. It is switched on or off by the driller at the rig floor. The driller must remember to switch it on and then switch it off when the trip has been completed. This sequence of operations wipes the pipe clean so mud is not splashed on the rig floor.

One aspect of the present disclosure is that the pipe wiping begins with upward movement of the pipe string, and continues with upward movement as long as that movement occurs. The upward movement is detected and transferred to a control system which automatically starts the wiping process. That is detected typically by measuring the mud pump output pressure. A specified threshold pressure is established, and operation above that level forms a signal indicative that the pipe is moving, downwardly either during drilling or is suspended in the well with rotation but without drilling. In this instance pump pressure is maintained high so the flow of mud continues and the well is maintained under control by the mud. When the pressure of the mud pump is reduced, the reduction in mud flow and related pressure in the mud system creates a signal that the pressure is so low that drilling has ended and the drill pipe is being pulled from the well. Wiping is then needed. In an alternative aspect, continued upward movement of the pipe is detected and forms a signal which automatically operates the wiping mechanism.

The wiping mechanism positions a set of air jets around the pipe which blow the mud downwardly. The device includes an air manifold and associated air lines. The lines are constructed and arranged so they blow air on the exterior. While the pipe string is pulled up, air pushes mud down the pipe.

The automatic system of the present disclosure is an improved system enabling pipe wiping (by air blowing on the pipe) to be automatically obtained at a drilling rig. It is summarized as including a pipe wiping mechanism having a set of air jets around the pipe and which are aimed toward the pipe. Operation is occasioned by at pneumatic control console arrangement. It is operated by a low pressure system. The control system is automatic and is triggered by operation by a mechanism which detects upward movement of the pipe. It is either detected directly by measuring movement of the pipe or it is detected by inference by change in rig conditions associated with retrieval of the pipe string. It automatically starts air flow to wipe mud down the pipe.

BRIEF DESCRIPTION OF THE DRAWINGS

So that the manner in which the above recited features, advantages and objects of the present invention are attained and can he understood in detail, more particular description of the invention, briefly summarized above, may be had by reference to me embodiments thereof which are illustrated in the appended drawings.

DETAILED DESCRIPTION OF THE PREFERRED EMBODIMENT

Figure 1:
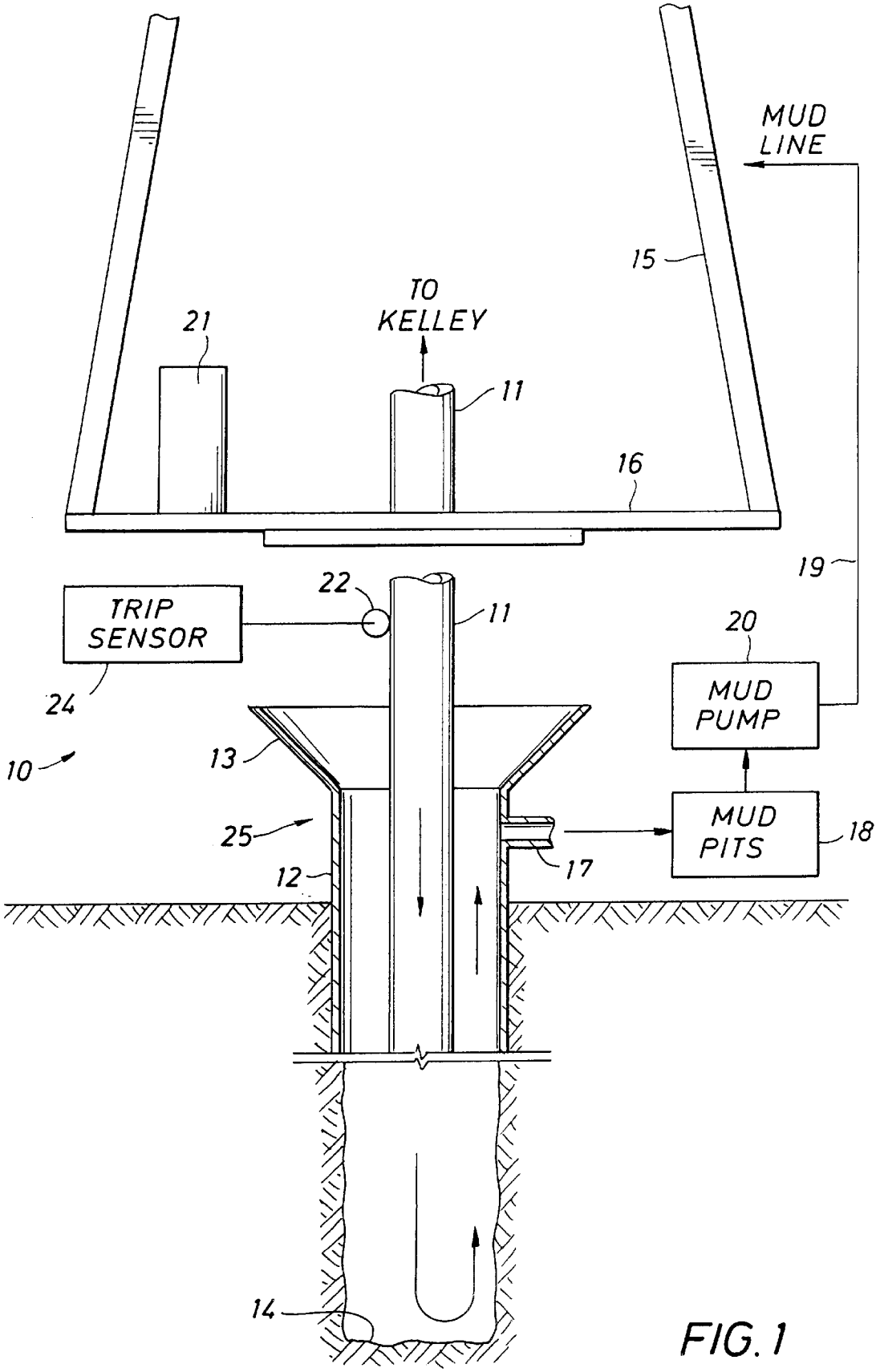
FIG. 1 of the drawings shows a pipe wiper installed to wipe the exterior of a string of drill pipe to prevent mud from spilling on the rig floor wherein the equipment is installed below the rig floors.

Attention is now directed to FIG. 1 of the drawings where a drilling rig is illustrated. It will be described in sonic detail. After that description, the pipe wiping apparatus will be discussed in conjunction with the control system. Proceeding therefore in general terms, the numeral 10 identifies a drilling rig above a partly drilled well. A drill string 11 extends downwardly into a surface conductor pipe 12 which connects to a bell nipple 13 to guide the drill hit into the conductor pipe. The well can have any depth and extends to a bottom 14 as shown in FIG. 1. A drill bit (omitted for sake of clarity) is affixed to the bottom end of the drill stem. The drill stem normally includes one or more drill collars which provide stiffening to the drill pipe so drilling can continue in a straight path. The drill collars (again omitted for clarity) define the lower end of the drill stem and connect to the drill string 11.

The drilling process is carried out utilizing a derrick 15 which is above a rig floor 16. There is an overhead draw works which raises and lowers the drill stem and connects with it through a Kelley which extends into a rotary table at the rig floor. The Kelley is a non-round pipe joint that fits in a conforming non-round hole in the rotary table. This imparts drilling rotation to the string of drill pipe. The Kelley is turned by the rotary table so the drill string is advanced by drilling down the length of one joint, and thereafter adding another joint of pipe in the drill string. The Kelley is momentarily threaded to the drill string and is later unthreaded while supporting the drill string in the rotary table with a set of slips. The slips are removed to continue drilling. The Kelley is part of the mud flowpath. The mud flowpath is a cycle flowpath enabling the mud to flow in a closed circuit. Water is added to the extent that it is lost in the drilling process. Drilling fluids are added, typically being provided in large bags which are dumped into the mud system to mix with added water and the recycled mud.

As shown in FIG. 1, mud flows down through the (drill string, through the drill bit and washes the borehole bottom 14 and returns up in the annular space as illustrated. It flows back to the surface and flows laterally by accumulating in the surface conductor pipe 12 below the bell nipple 13. The pipe 17 extends to the side to direct the mud flow to the mud pits 18. As necessary, the mud may pass through various devices which remove sand, cuttings, and bubbles of entrained gas. A mud line 19 delivers mud under pressure from a mud pump 20. The mud line extends to the upper part of the derrick 15 to connect through the swivel under the traveling block and extends through the swivel to provide fluid connection into the Kelley. As noted, the Kelley is a hollow pipe.

Typically, a driller will be on the rig floor and is provided with a driller's console 21. The driller's console supports a number of control instruments, meters and the like to inform the driller of events occurring on the rig. In addition, FIG. 1 shows a pipe motion sensor which is involved in operation. The sensor 22 measures movement of the pipe string. It provides a signal to a trip sensor 24 which will be described in detail.

The foregoing sets out the context in which the pipe cleaner 25 is installed and used. The pipe cleaner 25 will be briefly detailed with regard to FIG. 3 of the drawings. The drill pipe 11 is sometimes pulled upwardly as occurs in a trip. While there might be 10,000 feet of pipe, that length of pipe is normally formed by threading together similar or identical joints of pipe. Each joint is about 30 feet long.

Figure 2:
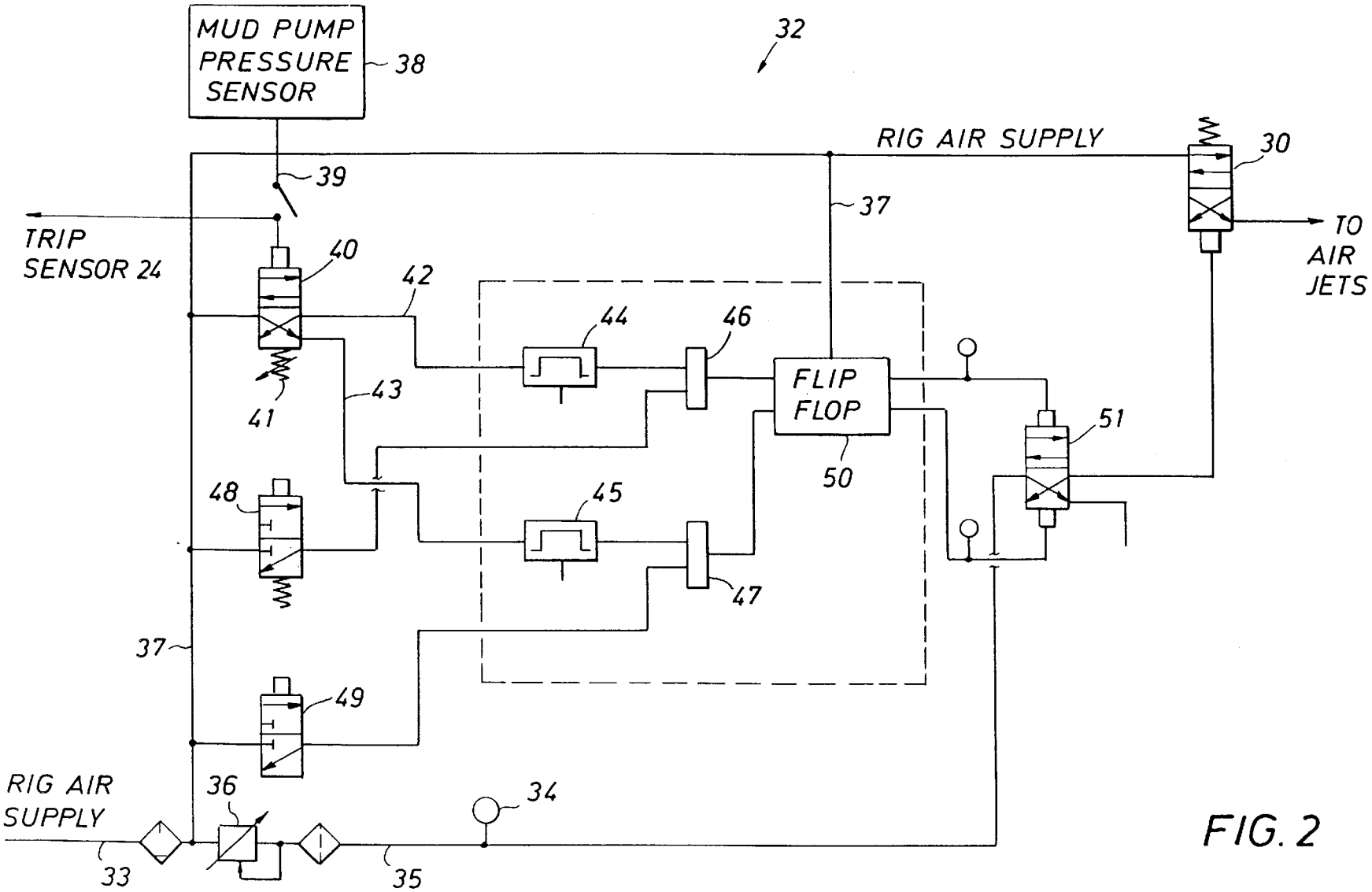
FIG. 2 of the drawings is a schematic control diagram showing a pneumatic control system for the pipe wiping apparatus.

A control system is illustrated in FIG. 2 of the drawings and is generally identified by the numeral 32. Its interconnection with the other components at the rig will be given so the context of its operation will be more readily apparent. The control system 32 is connected with a rig air supply line 33 which furnishes air at an elevated pressure. The pressure is dropped to a pressure indicated on pressure gauge 34. For the sake of convenience, that gauge is normally located at the driller's console 21 shown in FIG. 1 of the drawings. The pressure in the line 35 is dropped by means of a pressure regulator 36. Rig air is normally supplied at about 100 psi or greater. Rig air at that pressure is too high for use in this system. To be sure, there is a line 37 which delivers the high pressure rig air which is used in the logic system to be described. However, actuation of the pipe cleaner 25 is controlled by a reduced air pressure on the line 35. The line 35 thus delivers a reduced pressure. There will be an explanation below of how a reduction to perhaps 15 to about 25 psi provides an acceptable operating range. Continuing, however, with the logic circuit shown in FIG. 2 of the drawings, there is a mud pump pressure sensor 38 which is connected to the mud pump to sense the output pressure of mud from the pump 20. The mud pump is normally operated at a relatively high pressure. Mud pressure is maintained at a desired high level for operation of the drilling rig. To assure the pipe does not stick and that proper circulation is maintained in the well, the mud pressure is kept at an elevated level. While it may vary widely, it is still several hundred psi and is substantially above some arbitrary threshold level of perhaps 400 psi. When a trip occurs, the mud pressure in the drill string is dropped under the threshold level. It is continued at that reduced level during the trip to assure the well is filled with drilling fluid so a blowout does not occur. Therefore, the sensor 38 is set to some level that is below the normal drilling pressure maintained by the mud pump 20 and above the pressure level at which a trip occurs. That pressure is typically in the range of about 300 to about 500 psi. Obviously, that pressure will differ when different conditions are encountered in the well. When the pressure demarcation is decided, the system then operates with or is responsive to the pressure from the pump which is indicative that regular drilling has ended and a trip has begun.

The present invention includes the control system schematic of FIG. 2 which triggers operation of the equipment during a trip. There is no need to wipe the exterior of the drill pipe when the pipe is going down. While the drill string is drilled down, the pipe cleaner does not operate.

In the alternative, FIG. 1 shows the pipe motion sensor 22 operating with the sensor 24. When sufficient upward movement occurs, such movement normally signals a trip, and the trip sensor 24 senses that action. That forms a signal on a separate signal line. The signals are input to a switch 39, and operate the pilot of a sensor valve 40. The sensor valve 40 is pilot operated against a bias sprint 41. If, desired, the spring 41 can be adjustable. This enables adjustments to be made to assure the valve 40 will trip when the mud pressure sensor 38 or the trip sensor 24 provides the requisite signal.

The high pressure supply line 37 is input to the valve 40. When the valve 40 operates, it forms an output signal. That output signal is a steady state signal on either of two lines, the lines being identified at 42 and 43. The line 42 is input to a single shot logic element 44 while the line 34 is input to a similar single shot logic element 45. The logic elements 44 and 45 convert the change in the steady state signal into a pulse of specified height and duration. In turn, those output pulses are provided to OR gates 46 and 47.

For the convenience of the driller, override valves are located on the console. An override (manually operated) valve 48 is handy to the driller and is immediately adjacent to a similar override valve 49. While the first provides cleaning air flow, the second ends that flow. The valves 48 and 49 are push button operated. When released, they return to the illustrated position at the urging of a bias return spring. As will be understood, the signals from the valves 48 or 49 are input through the respective OR gates 46 and 47.

The OR gates 46 and 47 input toggle signals to a flip flop 50. The flip flop 50 is toggled in operation. It forms two outputs. One output will go high and the other will go low on operation. Recall the line 37 is input to the flip flop 50; therefore the high signal level is determined by the pressure on that line. The pressure on the other line is substantially equal to atmospheric pressure. The flip flop 50 controls operation of a downstream bistable switching valve 51. That valve is operated to direct reduced rig pressure on the line 35. The valve 51 is connected so an air flow control valve 30 is operated. The valve 51 is switched under control of the flip flop 50 to cause the pneumatic powered valve 30 to open and switch air on or off for the pipe cleaner 25. It is desirable that the rig air supply be plumbed to the cleaner 25. Reduced rig pressure on the line 35 is typically in the range of about 15 to about 25 psi. The precise pressure is somewhat dependent on the diameter of the lines to the control valve 30.

Operation of the mud cleaner 25 is automatic. Is it sensed either by the trip sensor 24 or the pressure of the mud at the pump 20 as recognized by the sensor 38. Any change in condition including manual override through the override switches 48 and 49 is automatically input through the logic to control the flip flop 50, change the control valve 51 and the pneumatic valve 30 shown in FIG. 2.

AIR JET WIPING MECHANISM

Figure 3:
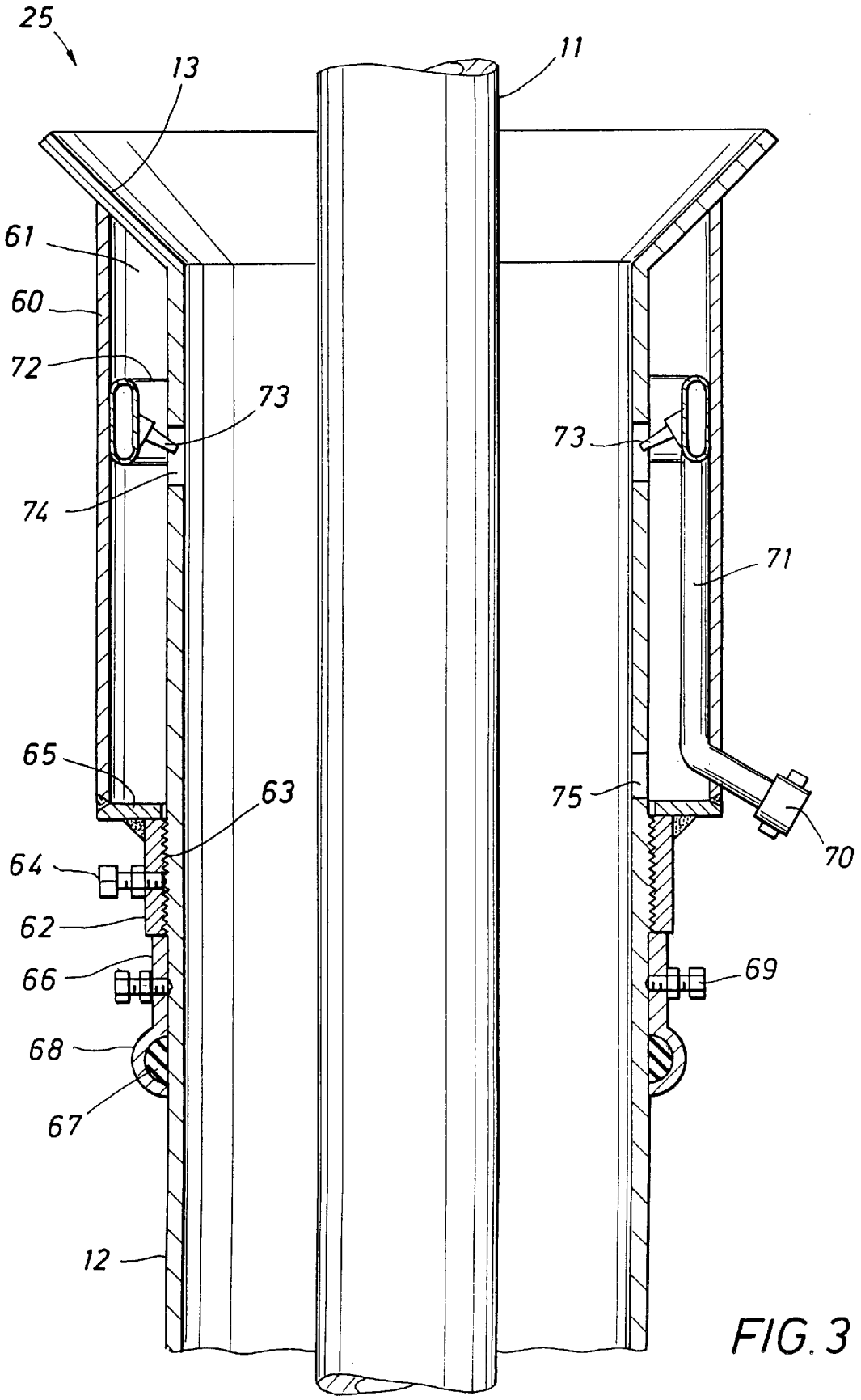
FIG. 3 of the drawings is a sectional view of the air powered mud wiping apparatus which blows down on the pipe for wiping.

Going now to FIG. 3 of the drawings, one embodiment of the pipe wiper 25 is illustrated in detail. The present disclosure sets forth the set of air jets which are described below and which are used to wipe mud from the drill string. Referring momentarily back to FIG. 1 of the drawings, this is equipment which is installed at the very top end of the pipe 12. In actuality, it is located above the lateral line 17 which removes mud from the annular space. It is located below the bell nipple 13. It is located in an area so that no special added equipment is required for mud handling. That is, mud is wiped from the drill pipe 11 and is forced back down into the annular area. The mud wiper 25 is installed just above the level of the lateral line 17. By placing it at that height, mud on the drill pipe 11 is forced downwardly back into the annular space and is removed with the major mud removal system. As shown in FIG. 2 of the drawings, the control valve 30 is provided with rig air supply through the line 37. This flow is stopped at the control valve 30 as long as drilling proceeds. The control system 32 supervises this operation. In fact, it is not necessary that the mud wiping system operate except at the moments when the drill string is pulled during a trip. If, for instance, it is necessary to raise the drill string a few inches to place slips in the rotary table, that can be readily done without triggering operation. Operation, however, is triggered when either of two events is measured or noted, one being continued upper movement of the pipe 11 or the other being reduction of the pressure at the mud pump 20 which pressure reduction is sensed and which reduction in pressure is coextensive with pulling the drill string. In any case, that is the timing which triggers operation of the air powered wiping operation.

Going now to FIG. 3 on the drawings, the drill pipe 11 again is shown centered below the bell nipple 13. It is shaped in the fashion of a cone to direct different sized drill bits into the conductor pipe 12. Considering now the structure that is actually shown, easy assembly and disassembly is accomplished. It is common to make the bell nipple about 16 inches in nominal diameter. This will accommodate most large drill bits. At the time of drilling down the well through the conductor pipe 12, the nominal 5 inch drill pipe 11, with the drill bit on it, is lowered through the conductor pipe 12 and drilling continues. The conductor pipe 12 is typically joined to the bell nipple 13 with a weld. On the exterior, the present disclosure contemplates placing a larger pipe, typically a 20 inch pipe section 60. The pipe section 60 is normally only about 10 to 30 inches in length. The optimum length is around 20 inches so that it fits under the bell nipper 13 located at the top end of the conductor pipe. This defines a chamber 61 in which certain equipment is located as will be explained. The pipe 60 is attached by incorporating a threaded collar 62. That threads to a set of matching threads 63 located on the exterior of the conductor pipe. A set screw 64 is used to anchor the internally threaded collar portion 62. It terminates at a flange 65 which defines the lower end of the chamber 61. The flange 65 is welded to the pipe 60. The connection at the threaded joint 63 is enhanced by including a lower sleeve 66 supporting a semicircular gasket 67 located in a matching circular chamber 68. This defines a surrounding narrow chamber having a cross-sectional area as illustrated for receiving the preferably expandable air inflated semicircular gasket 67. It is a commonly used device to provide a pneumatically powered seal. This is locked and held in place by screws 69.

The chamber 61 is provided so that it encloses a set of air nozzles 73. Air is delivered through a fitting 70 which is connected by suitable air line with the control valve 30 previously mentioned. The control valve 30 is normally switched so that no air flows to the fitting 70. However, when a trip begins, the control system 32 shown in FIG. 2 operates the valve 30 and the valve 30 provides air at rig pressure to the fitting 70. The fitting 70 connects with a feed line 71 which extends into the chamber 61. There is a circular air manifold 72 deployed in a circle around the chamber 61. The cross-sectional area of the fitting 70, the line 71 and the manifold 72 is made fairly large and relatively uniform so that adequate flow is delivered to a plurality of air nozzles. A nozzle 73 is positioned in the chamber 60 and has an outlet tip which is pointed through an opening 74 formed in the conductor pipe. The opening 74 is located so that the nozzle directs a blast of air toward the drill pipe 11. As shown on both sides, the nozzles 73 are replicated at several locations. The nozzles are canted downwardly so that the air blast is directed from all the nozzles toward the pipe and somewhat downwardly. Ideally, the nozzles are sized and pointed so that they direct a somewhat expanding flow of air. Dimensions are noted below. Typically, there are at least four and preferably five or six nozzles. They are arranged at equal azimuthal spacing. For instance with six, they are deployed at 60° intervals around the drill pipe 11. They are inclined to blow downwardly at an angle of about 15° to 30°. The nozzle openings can be round, i.e., about 0.125 inches, but they actually work better if they are somewhat flattened, having a width which is greater. Nozzle openings of about 0.125 in height and about 0.25 in width define a rectangular air flow which is relatively wide. The lower end of the chamber 61 is provided with a port 75 which drains that region so that mud does not accumulate in the chamber 61.

Typically, the conductor pipe 12 has a nominal 16 inch diameter while the drill pipe typically is about 5 inches in nominal size. This defines about a 5 inch gap between the nozzle and the conductor pipe 12. This gap of about 5 inches is between the drill pipe 11 and the several nozzles 73. Using slightly oval or oblong openings, the air flow comprised of four, five or six jets of air directed inwardly and downwardly converges at the pipe and forces mud on the pipe to flow down the pipe. The dimensions just mentioned are true especially when the pipe is exactly concentric but that is not always the case. Often, the pipe is bent and will wobble while rotating. It might be eccentered, and it also typically includes external upsets of known dimensions. Dynamically, the pipe will therefore wobble. It is surrounded by the blast of air coming from all directions striking the pipe and flowing around the pipe in a generally downward direction, thereby pushing the drilling mud down the pipe 11. Mud is therefore forced to flow down the pipe 11 and the pipe is substantially clean of surplus mud as the drill string is pulled. Even should there be a substantial crook or bend in the pipe, with or without drill collars, the air jets directed radially toward the pipe 11 cause the air to flow fully around the rotating pipe and deflect the drilling mud downwardly. In effect, this forces the mud on the drill pipe back into the annular space where it is recycled in the conventional fashion. Above the air wiper 25, the drill pipe is substantially dry and relatively clean. One aspect of the equipment shown in FIG. 3 is that it is relatively easily installed and later removed. At the time of assembly of the drilling rig and after the conductor pipe 12 is placed under the rig floor, the next step is normally installation of the bell nipple. This equipment can be installed on the top of the conductor pipe in just a few moments of time.

While the foregoing is directed to an embodiment and variations, the scope is determined by the claims which follow.

What is claimed is:

1. A method of automatically wiping the exterior of a drill stem being pulled wet from a well borehole wherein the method comprises the steps of:

(a) detecting upward movement of a drill stem exceeding a specified minimum of upward movement wherein a signal is formed that upward movement has exceeded that minimum and has continued, and wherein said detecting upward movement includes measuring drill string movement;

(b) in response to the signal, wiping mud from the drill stem by directing a flow of air against the drill stem as it is raised from the well borehole to blow mud down the drill stem; and (c) continuing the mud wiping process as long as the drill stem is raised from the well borehole.

2. The method of claim 1 wherein upward movement is measured at a location below a rig floor and above the well borehole.

3. The method of claim 1 wherein the step of directing the flow of air includes using a set of air jets directed against the drill stem.

4. The method of claim 3 wherein said air jets surround said drill stem.

5. The method of claim 4 wherein the step of using the set of air jets is initiated by a pneumatic control signal.

6. The method of claim 1 including the step of forming a pneumatic pressure signal dependent on said upward movement signal;

applying the pneumatic pressure signal to a pneumatic logic circuit; and wherein the mud wiping process includes controlling the start and end of air flow with the pneumatic logic circuit.

7. The method of claim 6 including the step of forming a sustained pneumatic logic control signal for as long as the drill stem is being raised from the well borehole.

8. The method of claim 7 including defining a pneumatic logic circuit having output pneumatic control signals wherein one signal starts air flow and the other signal ends air flow.

9. The method of claim 8 including the step of forming a driller generated override signal for said logic circuit.

10. The method of claim 9 including the step of placing a driller controlled switch above the rig floor and transmitting a pneumatic signal to said logic circuit so that said logic circuit operates a pneumatic cylinder in response to said driller controlled switch.

11. A method of wiping mud from a drill stem retrieved from a well borehole during a drilling process wherein the method comprises the steps of:

(a) monitoring mud pressure delivered to the drill stem to observe a decrease in said mud pressure below a predetermined level which is indicative that the drill stem is being pulled from the well borehole;

(b) upon observing such a decrease, thereafter in response thereto, initiating an air flow against the drill stem at a location below a rig floor to wipe mud from the drill stem to thereby reduce the amount of mud on the exterior of the drill stem;

(c) continuing the air flow so long as the drill stem is removed from the well borehole;

(d) blowing the mud downwardly along the drill stem back into the well, and (e) upon observing an increase in said mud pressure above said predetermined level, terminating said air flow.

12. The method of claim 11 wherein said initiating and said terminating of air flow is implemented by logic elements which convert changes in said monitored mud pressure into pulses of specified height and duration in cooperation with a flip flop.

13. The method of claim 12, including the step of initiating and terminating said air flow with manually implemented signals to said flip flop through at least one OR gate.

14. The method of claim 13 including the step of forming a pneumatic signal to initiate said air flow toward the drill stem in response to an output signal from said flip flop.

15. The method of claim 14 wherein multiple air flow jets are mounted around the drill stem and are directed toward the drill stem to wipe mud downwardly.

16. The method of claim 15 wherein the step of wiping mud downwardly is initiated by a pneumatic control signal.

17. The method of claim 11 including the step of forming a pneumatic pressure signal dependent on a reduction in said monitored mud pump pressure below said predetermined level;

applying the pneumatic pressure signal to a pneumatic logic circuit; and wherein mud wiping includes controlling the start and end of air flow with the pneumatic logic circuit.

18. The method of claim 17 including the step of forming a sustained pneumatic logic control signal for as long as the drill stem is provided with reduced mud pump pressure.

19. The method of claim 18 including defining a pneumatic logic circuit having output pneumatic control signals wherein one signal starts air flow and the other signal ends air flow.

20. The method of claim 19 including the step of forming a driller generated override signal for said logic circuit.

21. The method of claim 20 including the step of placing a driller controlled switch above the rig floor and transmitting a pneumatic signal to said logic circuit so that said logic circuit operates a pneumatic cylinder in response to said driller controlled switch.

22. Apparatus for removing mud from the exterior of a drill stem as the drill stem is retrieved from a well borehole wherein the drill stem has mud on the exterior and the apparatus comprises:

(a) movement detector detecting upward movement of a drill stem being pulled from a well borehole wherein the drill stem has drilling mud on the exterior of the drill stem;

(b) air flow jets around and directed toward the drill stem to wipe mud therefrom;

(c) a control system for controlling the air flow toward the mud on the drill stem to thereby start and end air flow toward the mud for mud removal, said control system comprising (i) two single shot logic elements cooperating with said movement detector, (ii) a flip flop activated by signals from said single shot logic elements, and (iii) a bistable switch valve to start and end said air flow dependent upon a setting of said flip flop; and (d) wherein said movement detector tracks the drill stem as it is pulled from the well borehole and controls the air flow at the drill stem during any pulling from the well borehole.

23. The apparatus of claim 22 wherein said air flow jets are:

(a) connected to circular flow manifold:

(b) inwardly and downwardly directed;

(c) mounted around a conductor pipe; and (d) positioned in a surround chamber about said conductor pipe.

24. The apparatus of claim 22 including an air flow jet chamber for said jets.

* * * * *